United States Patent [19]

Husebye

[11] 4,431,346

[45] Feb. 14, 1984

[54] METHOD OF PRODUCING LARGE BODIES OF ICE

[76] Inventor: Eystein Husebye, Grimelundshaugen 12, Oslo 3, Norway

[21] Appl. No.: 215,008

[22] Filed: Dec. 10, 1980

[30] Foreign Application Priority Data

Feb. 28, 1980 [NO] Norway ..... 800570

[51] Int. Cl.[3] ..... E02B 17/00; E02D 23/08

[52] U.S. Cl. ..... 405/217; 405/203

[58] Field of Search ..... 405/61, 203, 211, 217, 405/130; 62/260

[56] References Cited

U.S. PATENT DOCUMENTS

| | | | |
|---|---|---|---|
| 3,738,114 | 3/1973 | Bishop | 61/46.5 |
| 3,750,412 | 4/1973 | Fitch et al. | 61/46 |
| 3,849,993 | 8/1974 | Robinson et al. | 61/46 |
| 3,863,456 | 7/1975 | Durning | 61/46 |
| 3,931,715 | 1/1976 | Fitch et al. | 405/217 |
| 4,048,808 | 7/1977 | Duthweiler | 61/103 |
| 4.055,052 | 10/1977 | Metge | 405/217 |
| 4,094,149 | 6/1978 | Thompson et al. | 405/217 X |
| 4,187,039 | 2/1980 | Jahns et al. | 405/217 |

*Primary Examiner*—David H. Corbin

*Attorney, Agent, or Firm*—Rines and Rines, Shapiro and Shapiro

[57] ABSTRACT

This disclosure is concerned with novel water-tight boxes for submergence in the sea, containing preferably fresh-water ice produced in another location and inserted into the box, with cooling means associated with the box that compensates for heat from the environment surrounding the box that would otherwise commence to melt the ice.

8 Claims, 4 Drawing Figures

METHOD OF PRODUCING LARGE BODIES OF ICE

The present invention relates to a method for producing large bodies of ice to be used, for instance, as foundations for off shore oil drilling or production equipment, as breakwaters, quays, for large fill operations and the like, whereby by means of a practical freezing method for freezing water a body of ice (an iceberg or ice island) is produced, being of such dimensions in the vertical direction that the load thereby produced against the sea bed is so high that the body is stably supported and thus capable of withstanding any forces to which it may be subjected, for example, from waves, wind, currents, collisions, etc.

The problems associated with offshore operations, i.e., providing foundations for and/or erecting structures on the sea bed in the ocean, are very great. This is particularly true in ocean regions with heavy seas and high winds. The problems are magnified even further if the ocean depth is relatively great, for instance 60–70 meters or more. A number of different structures for offshore operations are known. One such structure, the jack-up platform, consists of support legs which are movable in the vertical direction in relation to a deck such that the legs can be set down on the sea bed and the platform elevated into the air above the waves. Such structures are extremely vulnerable to corrosion and are also very expensive; moreover, they are suited primarily for drilling operations only, not as fixed production installations. Concrete structures are also known. These structures are produced on land and towed out to their destination, whereupon the float tanks are filled with water and the entire structure sinks down to rest on the sea bed. Such platforms are enormously expensive and are also subject to corrosion, the calculated lifetime for hitherto-known platforms of this type being about 20 years. In addition to the huge write-offs necessary during this period, one has the added job of removing the installation when it can no longer be used, which is extremely costly.

Quay installations, breakwaters and similar harbor installations require costly foundations or fill work, especially if the water is relatively deep. Often the costs are so exorbitant that it is impossible, both politically and economically, to perform the desired work.

It has previously been suggested to form bodies of ice (ice islands) for use as drilling platforms in arctic regions. By way of example, U.S. Pat. Nos. 3,738,114, 3,750,412, 3,849,993, 3,863,456 and 4,048,808 may be cited, all of which relate to methods of establishing artificial ice islands in shallow waters in polar regions, using naturally-occurring sea ice as a point of departure and reinforcing this by spraying sea water over it which gradually freezes. Such heavy and thick bodies of ice are eventually formed that in the course of a certain time, depending on weather and wind, the body of ice breaks through the sea ice and sinks down to the sea floor, forming an artificial ice island.

Attempts have also been made to utilize natural icebergs and ice floes for offshore activities in polar regions.

The object of the present invention is to provide a method whereby very large bodies of ice may be produced. In accordance with the invention, it will be possible to produce bodies of ice of 30,000 to 50,000 $m^2$ surface area or more, with a height of, say, 200 to 300 meters. With such dimensions, the artificial iceberg can be used for installations at great ocean depths and is thus a viable alternative to known concrete and steel structures, but with the advantage that its production costs are far lower, while at the same time the enormous dimensions enable one to use simpler and less expensive drilling and production equipment, since one can adapt the equipment more along the lines of land-based installations.

A further object of the invention is to provide, as opposed to the previously-mentioned U.S. patent specifications, a method for an industrial and controlled production of bodies of ice, independent of weather and wind, and to produce a body of ice which can be maintained in the frozen state continuously for 20 years or more, in cold as well as in more temperate waters.

Advanced technology and considerable amounts of energy are required to produce such large bodies of ice. Through the method of the invention, a technique is provided which makes efficient and not overly time-consuming production of such bodies possible, while also creating an opportunity for re-using the energy required to produce the ice.

A further aim of the invention is to provide a method which ensures that a stable body of ice is produced, such that creep in the ice due to the great pressures is avoided or held in control.

These objects are achieved according to the invention by a method which is characterized by the use of ice freezing machines which produce pieces of ice, for instance ice flakes (ice chips) or the like, which are thereafter frozen into solid ice in a mold floating in water, for example by means of supercooled water, cold air or a freezing mixture, or in that the chips of ice are at such a low temperature that water introduced between the chips will become frozen into solid ice.

A number of advantages are obtained by producing an iceberg in this manner. One is not dependent on a particularly arctic climate, naturally frozen ice, etc., on which the prior art solutions have been based. The ice can be produced, in other words, at a suitable location near the coast, enabling one to establish a fixed production site near larger or smaller population centers, with the advantages this entails both in regard to manpower and costs. When the production occurs on land, it is a relatively simple matter to obtain pure fresh water and inexpensive electrical power. Such resources are very often found available together, for example, at the planned production sites on Norwegian fjords. Large quantities of heat are produced during the freezing which, when production is landbased, can be used for heating purposes, for aqua-culture, or as the basis for new power production.

The use of pure fresh water for freezing creates few problems on the heat exchanger side in the refrigeration machinery, as opposed to the problems encountered when using salt water. The production site can be chosen such that melt water from glaciers, which has a very low temperature, can be utilized, thus optimizing the freezing process.

An industrial production on land also permits one to a great extent to utilize readily available components from the world's leading refrigeration engineering companies in the construction of the production equipment.

One problem which arises in connection with the freezing of very large bodies of ice is creep. When ice is subjected to great pressure, it becomes a semi-plastic mass which will flow in the direction of least resistance.

A body of ice which rests on the sea bed and is, e.g., 300 meters high, will be subjected to relatively large creep effects around the water line. At lower depths, the external water pressure will partially compensate for the creep.

Heavy equipment or heavy structures installed on top of the body of ice will increase the likelihood of creep in the ice at and above the surface of the water. This may be counteracted according to an embodiment of the invention by anchoring such heavy structures, for example, larger buildings, drilling towers and the like, deep down in the layer of ice, preferably below the water line. Thus, such heavy structures are anchored in a cross section of the ice in which the tendency for creep is slightest owing to the external water pressure.

In an alternative embodiment of the invention whose purpose is to facilitate floating the body of ice over more shallow passages, slab-shaped bodies are produced which are floated separately and subsequently assembled one on top of the next and anchored together, for example, after having passed through the shallow waters. In a further development of this technique, heating elements are placed between the slabs such that the slabs can be separated from one another by melting. Such an arrangement will enable one more easily to disassemble the structure. One can separate as large a portion of the top section of the ice structure as necessary in order to float the equipment which has been installed on top of the structure. It may be desirable to float the top section of the structure when moving to another drilling location, or, in arctic waters, to do so if there is a danger of colliding with natural, drifting icebergs. One can then float away the top section of the ice structure and let the iceberg pass, and subsequently float the top section back into place and secure it to the remaining part.

In the production of the body of ice, according to the invention, a flexible ring mold can be used which covers the circumference of the body in at least one section on both sides of the surface of the water. The mold, in a further development, can be anchored in the mass of ice by means of radial strut plates. A further development of this technique is characterized in that a second, concentric mold is arranged outside the flexible mold, and that a pressurized gas is introduced between the molds.

Creep can be limited by means of this technique, as the mold takes up part of the creep.

A further feature of the invention is that a channel running from the top of the body of ice down to the bottom can be provided. When the body is then positioned on the sea bed, a drill string can optionally be guided down through this cavity. If the cavity is made sufficiently large, the drilling equipment itself can be placed directly on the sea bed.

To obtain a seal against the external water pressure, in accordance with the invention, a skirt is placed at the lower surface of the body of ice, the skirt being forced down into the sea bed when the body of ice is lowered into position, and the temperature at least in the lower part of the body of ice being so low that permafrost forms in the sea bed. The sea bed will thereby be transformed into a solid mass which is securely attached to the skirt, and water is prevented from leaking into the cavity.

The invention will be elucidated in greater detail in the following description with reference to the accompanying schematic drawings, which illustrate embodiment examples of the invention.

Figure 1:
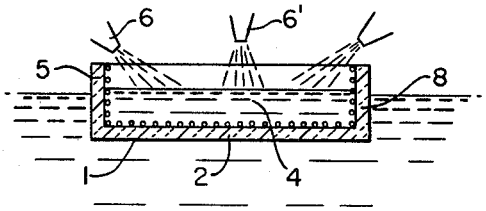
FIG. 1 shows the body of ice in an initial stage of its production.
Figure 2:
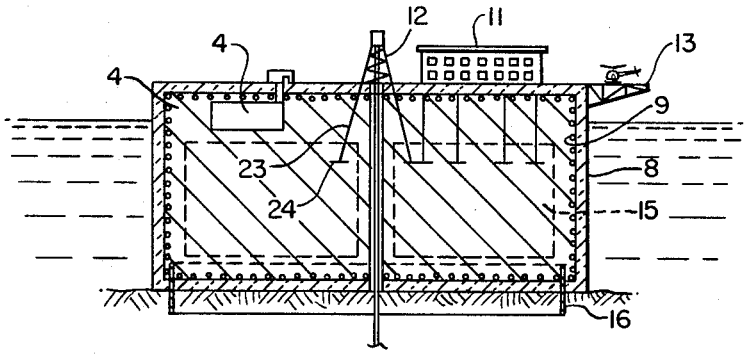
FIG. 2 shows an embodiment of a body of ice produced by the method of the invention and intended for use as a drilling or production platform.
Figure 3:
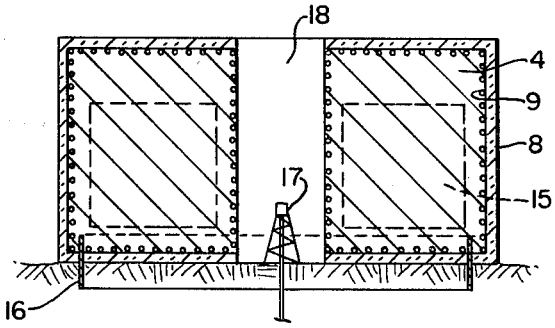
FIG. 3 shows a second embodiment of a body of ice produced by the method of the invention.

In accordance with the invention, a floating, watertight box or mold 1 consisting of a bottom 2 and surrounding side walls 3 is set out, for instance, in a quiet arm of a fjord. The box is made of suitable materials such as, for instance, a skeleton of wood or metal and an insulating material, for example, isopor. As the body of ice 4 is produced, one can extend the walls by means of joint members 5.

The freezing of the water can occur in several ways. Fresh water from a river or from a large lake in the vicinity is led to one or more ice plants which freeze ice flakes, ice cubes or the like. These flakes or the like are blown in an even stream through nozzles 6 into the mold. Together with the ice flakes from the nozzles 6, water at the lowest temperature possible can be sprayed in through nozzles 6'. The ice flakes from the ice-making machine are at such a low temperature that the water will freeze into solid ice between the ice flakes or ice cubes. Alternately, instead of ice flakes or chips or the like, the ice-making machines can produce a string of ice which can be coiled up in tight spirals on top of each other. For maintenance of the iceberg, the outer surfaces should be insulated by insulation material as indicated at 8. Above the surface of the water, this insulation can consist of sewn glass wadding or mineral wool mats with a protective and sun-reflecting skin, but it can also consist of strings of the above materials which are coiled as part of the above-mentioned spiral. At lower depths in the sea, owing to the pressure conditions, the insulation will have to be arranged in a somewhat different manner than above the surface of the water. One can imagine using one or more water-filled skirts of strongly-reinforced foil. The water in the skirts will have an insulating effect, and direct contact between the surface of the ice and water currents will be avoided. This technique can with advantage be used in combination with the above-mentioned coiling method, the skirts being unrolled gradually as the finished body of ice sinks down in the sea during production. The skirts are provided with weights or the like.

To remove the heat which penetrates through the insulation, one must place cooling elements 9 a distance interior of the insulation along the outer surfaces of the body. These can be cooling pipes which constitute a part of the above-mentioned spiral coils. The cooling effect can be controlled automatically according to temperature readings taken continuously by temperature sensors frozen and embedded in the ice.

As mentioned above, large quantities of heat will be produced in the production of the ice. This heat can be utilized as remote heat for nearby building complexes, or used for intensive cultivation of fish or mussels/oysters, or the heat can form the basis for a temperature-differential power station (cold fjord water versus the excess heat produced).

In order for it to be possible to float the body of ice in its mold from the production site to its erection site or destination, the vertical height of the body, and thus its draught, must not be so high that the body draws too much water to float over the shallowest point along the towing route. At the erection destination, the vertical height must then be increased such that the body in its mold will be sufficiently submerged to rest on the sea bed with so much pressure that it will be stable and able to withstand all the forces of currents, waves, wind and the like.

The planned equipment installations on the body of ice which cannot be done on land will then be installed at the destination. On the upper surface of the body of ice, buildings 11 and other structures such as a drilling tower 12 can be erected, or if the body of ice is to be used in connection with a production platform, valves, transfer equipment for loading tankers and the like can be placed on its surface. A helicopter terminal 13 or a short-runway airport could even be constructed, since, for offshore structures, the body of ice will have very large dimensions in the horizontal direction. If the ice structure is at depths of about 100 meters, a diameter of about 250 meters would not be unthinkable. Rooms for personnel, production locales 14 and the like and storage rooms 15 can be located inside the body of ice, in the same way as is done in Antarctic expeditions. One is then protected against weather and wind. Large ballast tanks, such as the store rooms 15, can also be utilized in connection with increasing the draught of the body at its destination. If a large store room 15 is cut into the ice at the production site, for example on land, this will of course give the body of ice a smaller draught than a solid body of ice of the same size. The rooms 15 can be made so large that the body of ice will float over the most shallow locations along its towing route. At the destination, the tanks 15 can be filled with supercooled liquid, for example, sea water having a higher salt content, such that the liquid is fluid at temperatures of about −5° to −8° C. The draught of the body will thereby be increased such that the body exerts such great pressure against the sea bed that one obtains sufficient stability. Oil and liquefied gas can also be stored in the storage tanks 15. When the storage tanks are not filled with oil, they can be filled with sea water if this is required to give the body of ice sufficient weight.

Direct access to the sea bed can be provided by arranging an internal cavity 18 extending from the top of the body of ice all the way down to the bottom. If one seals the body against the external water pressure by providing a surrounding skirt 16 which bores down into the sea bed owing to the great weight of the body of ice, one could install a drilling tower 17 or obtain direct access to the well head. Thus, one can establish the same conditions as on land when drilling or producing oil.

Heavy structures, for example, buildings 11 or a drilling tower 12, can affect the creep of the ice unfavorably. Creep will be largest in the region around the surface of the water, since there is little or no counterpressure from the outside here. It will therefore be desirable to guide the supports 23 for such building structures to a depth below the surface of the water, to a section where the tendency for creep in the ice is less. In this section, the foundations can rest on plates 24 which distribute the load.

To prevent water from leaking in beneath the skirt 16 and entering the cavity 18, such a low temperature is maintained in the body of ice, at least in the lower part of the body, that permafrost is produced in the sea bed such that it freezes to a sufficient depth to safeguard against water leakage.

Figure 4:
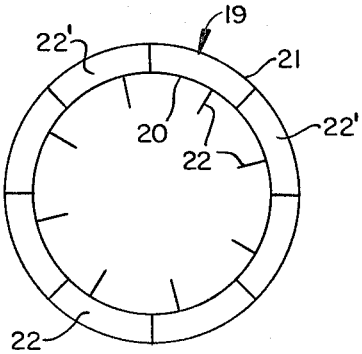
FIG. 4 depicts a mold for use in the production of a body of ice, in plan view.

When ice is subjected to great pressure, it becomes a semi-fluid mass, and creep will occur in the ice. To prevent this, the body of ice, at least in the region around the surface of the water, is produced inside a mold 19 (FIG. 4). This mold can consist of two concentric rings 20 and 21, the inner ring 20 being elastic such that it resists but gives with the creep. This ring is also provided with anchoring members in the form of radially-directed strut plates 22 which are frozen solidly in the ice. The outer ring 21 is a solid, rigid ring, and in the space 22' between the two rings pressurized gas can be introduced, by means of which one can control the creep resistance. The outer ring is so heavy that it will tend to slide down the body. This can be counteracted by arranging buoyancy tanks thereon, or by making the ring slightly conical in shape such that an upwardly-directed force arises in response to the creep of the ice.

Since the tendency of the ice to creep will occur particularly at the surface of the water, in an area where erosion by waves is also considerable, a preferred embodiment could also make use of insulated cassettes of concrete which are pressed inwardly against the surface of the ice by steel cables running from cassette to cassette all the way around the body. In this way one can obtain a wave break-up effect while at the same time providing thermal insulation and a counterforce against creep.

Furthermore, in order to reduce creep, a granular material such as sand, sawdust or the like can be frozen into the ice.

A granular material of this type, together with temperature control, will reduce the creep tendency, and depending on the circumstances could also act as ballast or an additional floating aid, according to whether one chooses a granular material having a higher or lower density than the ice. This feature of the invention, combined with the production method itself as described, makes it possible to produce bodies of ice of variable density, for instance in the vertical plane, the lower portion then being given a relatively higher density than the upper part, which can favorably affect stability and make possible an increased height in relation to width, which would otherwise be complicated to obtain. Furthermore, it is possible to produce bodies of ice which in their entirety are submerged beneath the surface of the sea and which for example could serve as a permafrost pedestal for conventional drilling and production platforms in the great ocean depths near the polar regions. The method can also be used to create artificial thresholds into fjords or narrow waters.

At today's price of electrical power in Norway (15 øre per kWh), it will cost about 7 kroner per $m^3$ in energy used to freeze 1 $m^3$ of ice. The corresponding price for concrete is about 400–500 kroner per $m^3$. Ice, therefore, is a very cheap production material.

Ice is a pure natural product and will return to nature if the structure is not to be utilized any more. One can then rig down the equipment, remove the insulation and let nature take its course.

The same considerations as outlined above can also be applied to the construction of larger harbour installations. Large breakwaters, quays, fills and the like can be made with the aid of bodies of ice.

The top of the iceberg can be covered, entirely or partially, by plates of pre-stressed concrete or of steel in order to obtain a favorable distribution of weight for heavier equipment and to avoid large partial pressures.

What is claimed is:

1. A method of providing a large body of ice for use in constructing a drilling platform, production platform, breakwater, quay, large fill and the like, comprising introducing an insulated floating mold into the sea near land, producing pieces of ice from fresh water by use of an ice-freezing machine, transferring said pieces of ice to said floating mold and freezing said pieces therein to form from said pieces a large body of ice in said floating mold, moving said floating mold with said body of ice therein to an erection site in the sea, increasing the draft of said floating mold and said body of ice therein until they are submerged sufficiently to rest stably by gravity on the sea bottom, and using the submerged mold and said body of ice therein in constructing said drilling platform, production platform, breakwater, quay, large fill and the like.

2. A method according to claim 1, characterized in that slab-shaped bodies are produced which are floated separately, assembled one on top of the next, and anchored to each other.

3. A method according to claim 2, characterized in that heating elements are provided between the slabs, such that the slabs can be separated by melting the ice.

4. A method according to claim 1 characterized in that a heavy structure, for example, a large building, a drilling tower and the like, is anchored deep down in the body of ice, below the water line.

5. A method according to claim 1 characterized in that the molding of the body is done in a flexible ring mold which covers the circumference of the body in one section on both sides of the surface of the water.

6. A method according to claim 1 characterized in that the lowermost part of the body of ice is maintained at such a low temperature that permafrost is produced in the ground beneath the body of ice at its erection site.

7. A method according to claim 1 characterized in that at the bottom surface of the body of ice, a downwardly-directed, surrounding, sealing skirt is arranged, which owing to the weight of the body is pressed down into the sea bed and prevents water from leaking into an internal cavity in the body, and that the lower part of the body of ice is maintained at such a low temperature that permafrost is produced in the ground beneath the body of ice at its erection site.

8. A method according to claim 1, characterized in that said body of ice in said floating mold is cooled to the extent that heat in the environment surrounding said mold is prevented from causing said body of ice to commence melting.

* * * * *